US009232846B2

(12) United States Patent
Fung

(10) Patent No.: US 9,232,846 B2
(45) Date of Patent: Jan. 12, 2016

(54) FOLDING BASE LED DIAMOND MIRROR

(71) Applicant: Conair Corporation, Stamford, CT (US)

(72) Inventor: Kam Fai Fung, Hong Kong (CN)

(73) Assignee: Conair Corporation, Stamford, CT (US)

( * ) Notice: Subject to any disclaimer, the term of this patent is extended or adjusted under 35 U.S.C. 154(b) by 87 days.

(21) Appl. No.: 13/911,587

(22) Filed: Jun. 6, 2013

(65) Prior Publication Data

US 2014/0362562 A1 Dec. 11, 2014

(51) Int. Cl.

| | |
|---|---|
| ***F21V 33/00*** | (2006.01) |
| ***A45D 42/10*** | (2006.01) |
| ***A45D 42/08*** | (2006.01) |
| ***A45D 42/16*** | (2006.01) |

(52) U.S. Cl.

CPC ..... *A45D 42/10* (2013.01); *A45D 42/08* (2013.01); *A45D 42/16* (2013.01)

(58) Field of Classification Search

CPC ..... F21V 33/004; F21V 21/30; F21V 33/00; F21Y 2101/02; Y10S 362/802; A47G 1/24; F21L 14/00; F21W 2131/302; A45D 42/10; A45D 42/16; G02B 25/005

USPC ..... 362/135–144, 249.01, 249.02, 249.03, 362/269.9, 276, 285, 287, 347, 370, 413, 362/418, 421, 427, 433, 494, 528, 530; 248/474, 475.1, 479–481, 485–487

See application file for complete search history.

(56) References Cited

U.S. PATENT DOCUMENTS

| | | | | |
|---|---|---|---|---|
| 388,346 | A * | 8/1888 | Duff | 362/141 |
| 2,861,501 | A * | 11/1958 | Strelakos | 359/802 |
| 3,936,156 | A * | 2/1976 | Shaw et al. | 359/802 |
| 5,392,162 | A * | 2/1995 | Glucksman | 359/872 |
| D379,125 | S | 5/1997 | Simjian | |
| 5,657,563 | A * | 8/1997 | Lane | 40/219 |
| 5,930,060 | A * | 7/1999 | Shih | 359/872 |
| 5,997,149 | A * | 12/1999 | Chu | 362/142 |
| 6,273,585 | B1 * | 8/2001 | Wu | 362/135 |
| 6,402,330 | B1 * | 6/2002 | Scheidegg | 359/879 |
| D509,369 | S | 9/2005 | Snell | |
| 6,955,329 | B1 * | 10/2005 | Shieh | 248/466 |
| 7,048,406 | B1 * | 5/2006 | Shih | 362/135 |
| 7,780,124 | B2 * | 8/2010 | Wang | 248/122.1 |
| 7,824,074 | B2 * | 11/2010 | Liou et al. | 362/269 |
| 8,038,332 | B2 * | 10/2011 | Lin | 362/494 |
| 8,162,502 | B1 * | 4/2012 | Zadro | 362/141 |
| 8,356,908 | B1 * | 1/2013 | Zadro | 362/136 |
| 2009/0108165 | A1 | 4/2009 | Huang | |

* cited by examiner

*Primary Examiner* — Hargobind S Sawhney

(74) *Attorney, Agent, or Firm* — Carter, DeLuca, Farrell & Schmidt, LLP

(57) ABSTRACT

A mirror apparatus (10) includes a platform (12), a mirror support (14) depending from the platform (12), a mirror member (16) mounted to the mirror support (14) and an illuminating member (34) mounted about at least a peripheral segment of the mirror member (16) for providing illumination. The mirror member (16) may include a first mirror side (24) having a substantially planar mirror surface and a second mirror side (26) having a magnifying mirror surface. The mirror support (14) may be mounted for movement relative to the platform (12) between a first operative position and a second transport position. The mirror support (14) may be mounted for pivotal movement relative to the platform (12) between the first operative position and the second transport position. The mirror support (14) may be adapted to be releasably secured in the first operative position.

12 Claims, 5 Drawing Sheets

56
12
28
32
18
32

14
32
22
20
36
12
18

32
34
24
28
32
22
20
12
18

FOLDING BASE LED DIAMOND MIRROR

BACKGROUND

1. Technical Field

The present invention relates to a mirror apparatus and, more particularly, relates to a foldable mirror apparatus having flat and magnifying mirror elements.

2. Background of the Related Art

Various designs exist and are commonly known for table or desk mirrors that are used for application of beauty products or the like to the facial area. Such mirrors are generally useful for their intended purposes, but are limited in their portability, versatility and ease of use.

SUMMARY

Accordingly, the present invention is directed to further improvements in mirror devices. In accordance with one embodiment, a mirror apparatus includes a platform, a mirror support depending from the platform, a mirror member mounted to the mirror support and an illuminating member mounted about at least a peripheral segment of the mirror member for providing illumination. The mirror member may include a first mirror side having a substantially planar mirror surface and a second mirror side having a magnifying mirror surface.

The mirror support may be mounted for movement relative to the platform between a first operative position and a second transport position. The mirror support may be mounted for pivotal movement relative to the platform between the first operative position and the second transport position. The mirror support may be adapted to be releasably secured in the first operative position.

The mirror support may include a frame segment for supporting the mirror and a base segment connecting the mirror support to the platform. The base segment of the mirror support is connected to the platform via a hinge, and may be adapted to pivot about the hinge between positions corresponding to the first operative and the second transport positions of the mirror support. A locking member may be mounted to the base segment of the mirror support. The locking member may be movable between an engaged position securing the mirror support in the first operative position and a disengaged position permitting the mirror support to move to the second transport position. The locking member includes a locking nut mountable to the base segment of the mirror support. The locking nut may be threadably engageable with a corresponding locking thread on the base segment, and movable to be secured against the platform to releasably secure the mirror support in the first operative position of the mirror support, and further movable to be disengaged relative to the platform to permit the mirror support to move to the second transport position.

The platform may include a recessed segment. The recessed segment is dimensioned to at least partially accommodate the base segment of the mirror support when in the second transport position of the mirror support. The illuminating member may be dimensioned and arranged to illuminate the first mirror side and the second mirror side. The illuminating member may be dimensioned to encircle the mirror member. The mirror may be mounted for pivotal movement relative to the frame segment of the mirror support to permit either the first or second mirror sides to face the user.

BRIEF DESCRIPTION OF THE DRAWINGS

Various embodiments of the present disclosure are described hereinbelow with references to the drawings, wherein.

and

FIGS. 8-11 illustrating a sequence of operations for unlocking the mirror support to permit the mirror support to move from the first operative position to the second transport apparatus;

DETAILED DESCRIPTION OF THE EMBODIMENTS

Figure 2:
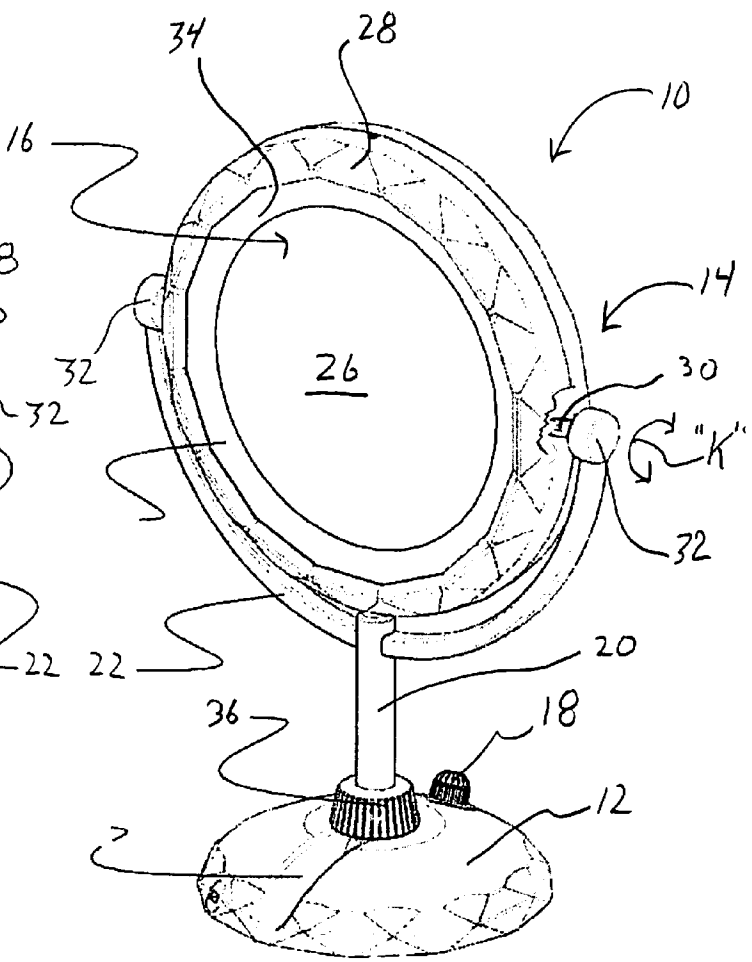
FIGS. 1-2 are perspective views of the mirror apparatus in accordance with the principles of the present invention illustrating the first and second mirror sides, respectively, of the mirror member.
Figure 1:
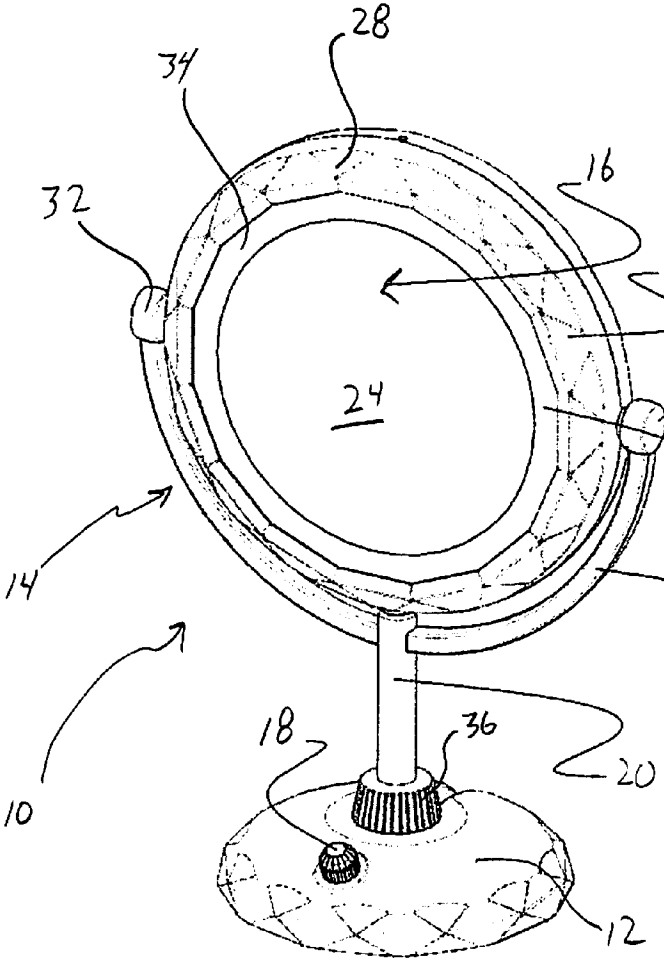

Referring now to the drawings wherein like reference numerals identify similar components throughout the several views, FIGS. 1-2 illustrate the mirror apparatus in accordance with the principles of the present invention. Mirror apparatus 10 includes platform 12, mirror support 14 mounted to the platform 12 and mirror member 16 mounted to the mirror support 14. Platform 12 is dimensioned to be placed on a desk or table top, and may be circular, rectangular or any other geometrical shape. Platform 12 has sufficient weight or mass to stabilize mirror apparatus 10 on the designated support surface. A switch 18 is mounted to the platform 12. Switch 18 may be adapted for rotation to toggle between on and off positions to open and close a circuit extending within platform 12 and/or mirror support 14.

Figures 3, 4, 5:
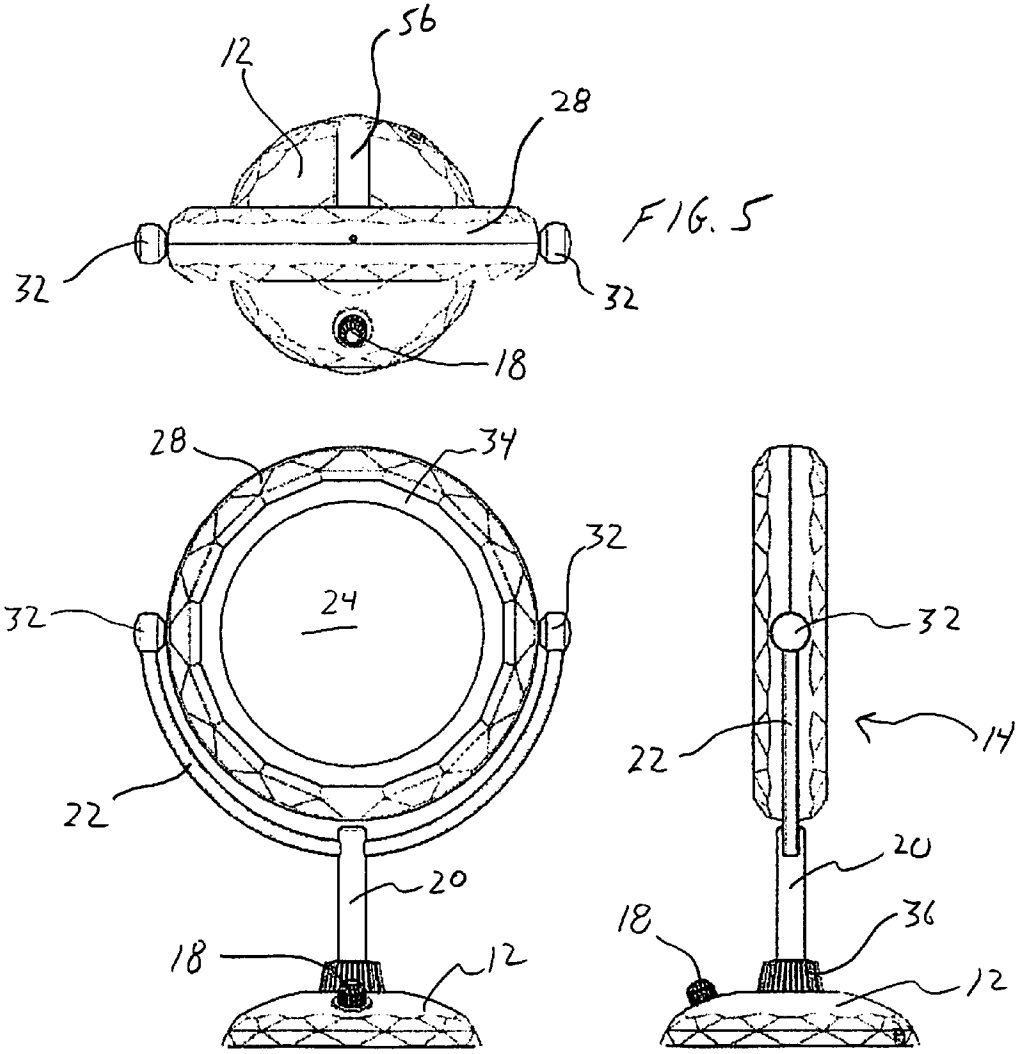
FIG. 3 is a front plan view of the mirror apparatus.
FIG. 4 is a side view of the mirror apparatus.
FIG. 5 is a top view of the mirror apparatus.

Referring now to FIGS. 1-2, in conjunction with FIGS. 3-5, mirror support 14 includes base segment 20 and c-shaped frame segment 22 connected to the base segment 20. Mirror support 14 is adapted for movement between a first operative position depicted in FIGS. 1-2 and a second transport position for ease of transport. The second transport position will be addressed in greater detail hereinbelow. Mirror member 16 includes first mirror side 24 having a substantially planar mirror and second mirror side 26 opposed to the first mirror side 24. Second mirror side 26 may have a magnifying mirror for producing a magnified or diminished image of the object, e.g., the face of the patient or may be substantially planar.

Mirror member 16 includes mirror housing 28 which is mounted to planar mirror of first mirror side 24 and the magnifying mirror of second mirror side 26 through conventional means. Mirror housing 28 is secured to c-shaped frame segment 22 through opposed fasteners or pins 30 (shown in the cut-away section of FIG. 2) which may depend from the c-shaped frame 22 and extend within the mirror housing 28. In one embodiment, mirror housing 28 may rotate about or through pins 30 in the directions of directional arrow "k" to permit the user to rotate mirror member 16 to permit either the first and second mirror sides 24, 26 to face the user. Pins 30 are operatively connected to manually engageable knobs 32 dimensioned and configured for engagement by the user. Knobs 32 are manipulated to rotate pins 30, and, thus mirror member 16 between the selective positions.

With continued reference to FIGS. 1-5, mirror member 16 further includes illuminating member 34 which is in electrical communication with switch 18. Illuminating member 34 may be circular in configuration and may extend about the entire periphery, or alternatively, a peripheral segment of mirror member 16. Illuminating member 34 may be a light emitting diode (LED) or, in another embodiment include another light source type such as lamps, fluorescent lighting, fiber optics or the like. Illuminating member 34 may be arranged to extend between first and second mirror sides 24, 26 of mirror member 16 to simultaneously illuminate the first and second mirror sides 24, 26. In the alternative, illuminating member 34 may incorporate two illuminating members 34 one for each mirror side 24, 26 and be independently controlled via an additional switch 18 (not shown).

With reference to FIGS. 1-2 and 6-7, mirror support 14 may include a locking member 36 for selectively locking the mirror 14 support in the first operative position and a second transport position. Locking member 36 may include locking nut 38 with internal threads 40 which threadably engage a corresponding threaded segment 42 of base segment 20. Locking nut 38 traverses along threaded segment 42 through rotational movement identified by direction arrows "m1, m2" (FIG. 7) to move between a first position engaging platform 12 and a second position disengaged from the platform 12, respectively. In the engaged position depicted in FIGS. 1-7, locking nut 36 is secured relative to platform 12 thereby securing mirror support 14 in the first operative position.

Figure 7:
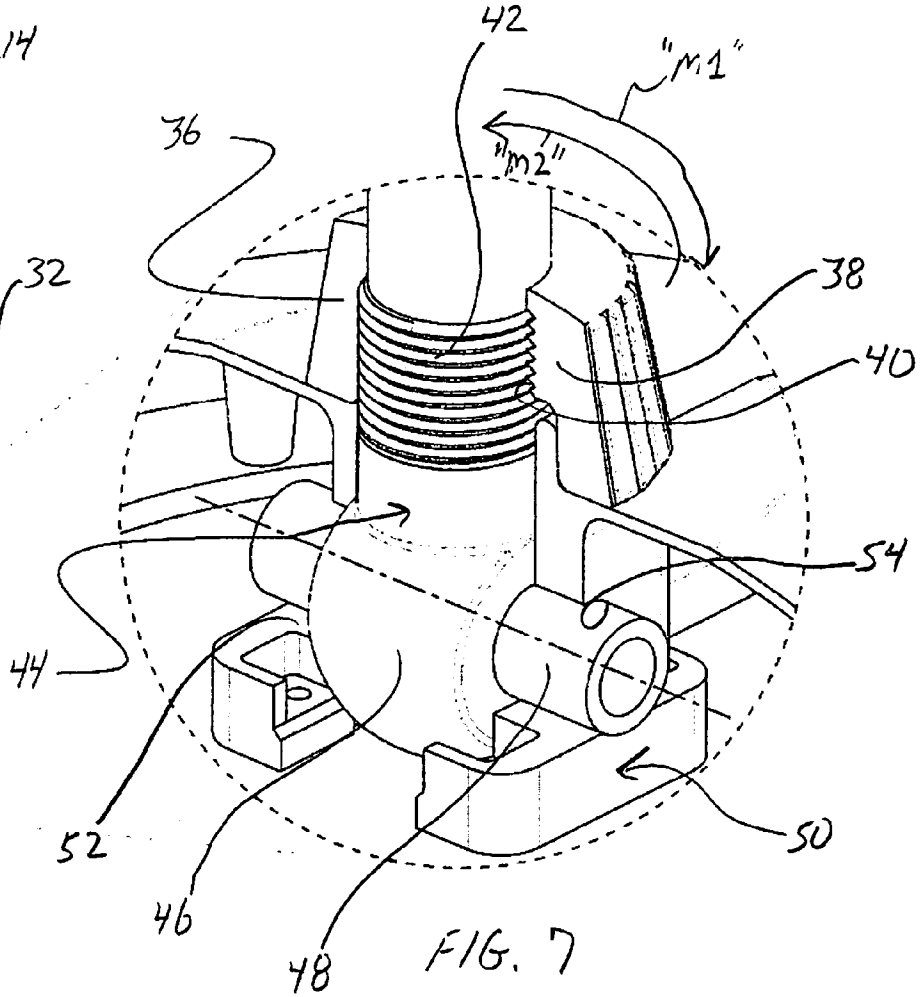
FIG. 7 is an enlarged isolated view of the area of detail identified in FIG. 6.
Figure 6:
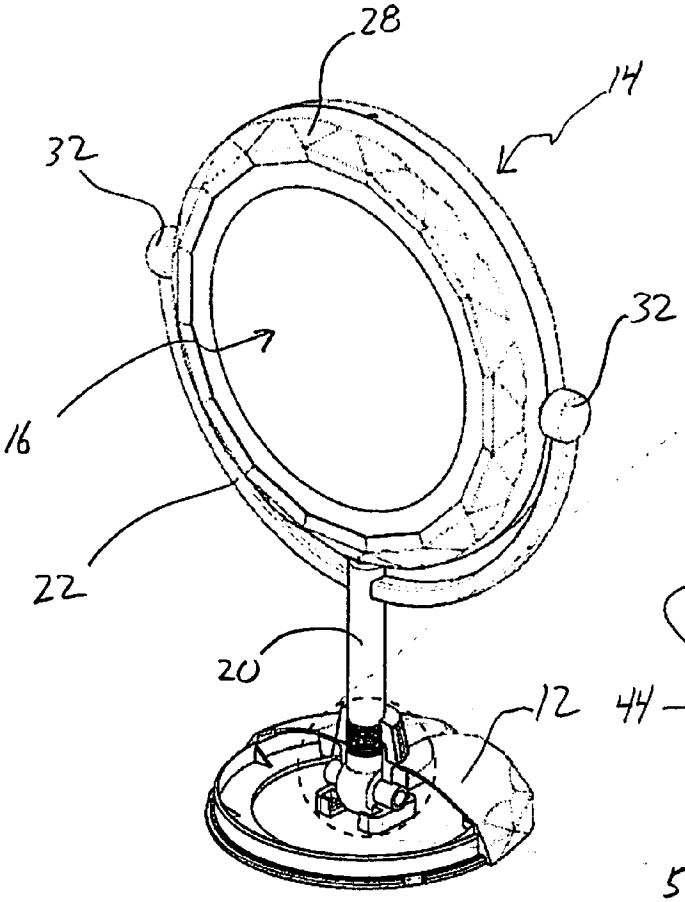
FIG. 6 is a perspective view in partial cross-section illustrating the hinge for pivotally mounting the support member to the platform and the locking member for securing the support member in the first operative position thereof.

Referring now to FIGS. 6-7, base segment 20 of mirror support 14 has hinge 44 connected thereto or integrally formed with the base member 20. Hinge 44 includes spherical element 46 and hinge pin(s) 48 extending through or depending outwardly on opposed sides of spherical element 46. Hinge pin 48 may be a separate component extending through an opening in the spherical segment 46 or be integrally formed therewith. Platform 12 includes hinge support 50 disposed within the interior of the platform 12. Hinge support 50 defines cradle segment 52 which accommodates spherical element 46 of hinge 44 and pin receiving grooves 54 for accommodating hinge pin 48. Base segment 20 pivots through cooperative engagement of hinge pin 48 traversing pin receiving grooves 54 of hinge support 50 to permit the base segment 20, and, hence, mirror support 14 to pivot between the first operative and the second transport condition of the mirror support 14.

Figures 8, 9, 10:
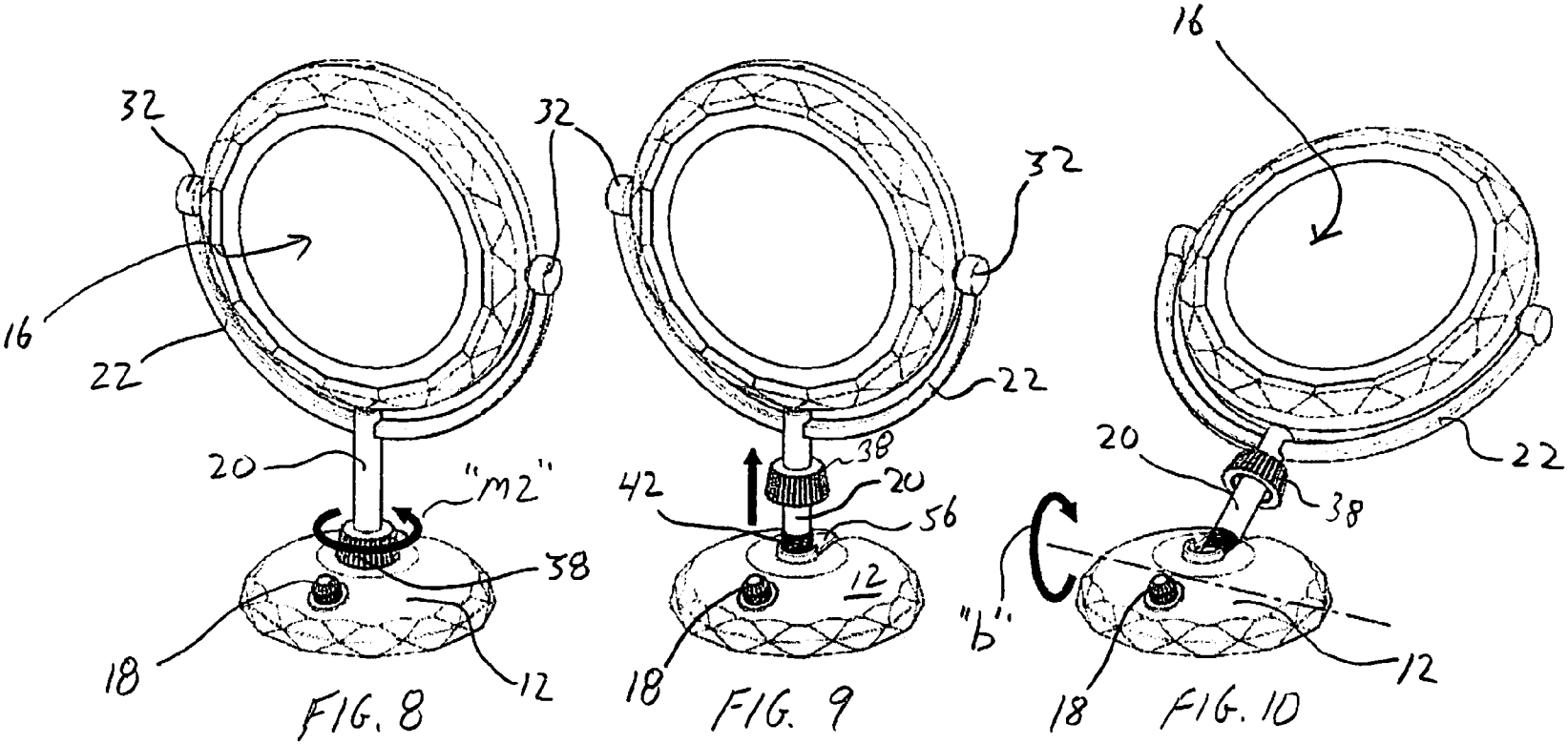
Figure 11:
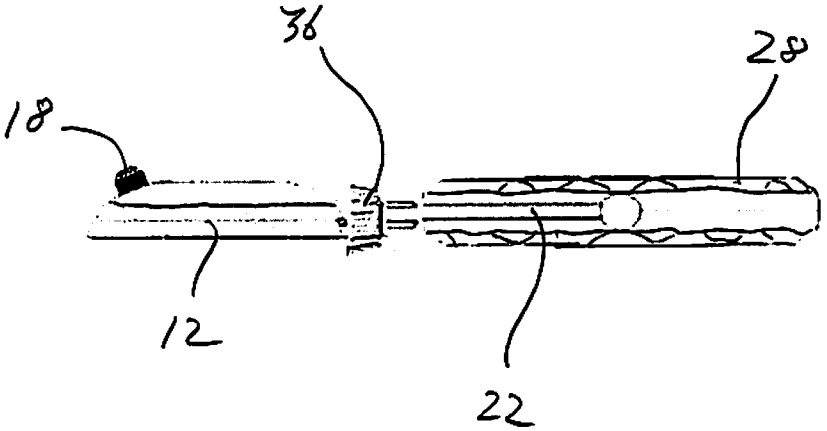

With reference now to FIGS. 8-10, in conjunction with FIG. 7, the sequence of operation of use of the mirror apparatus 10 and to effect transition of mirror support 14 from the first operative position to the second transport position will be discussed. Locking nut 38 is rotated in a counterclockwise direction "m2" relative to FIG. 8, to cause the locking nut 38 to traverse threaded segment 42 and move in a vertical direction relative to base segment 20 and be released from platform 12 as depicted in FIG. 9. Thereafter, mirror support 14 is pivoted about hinge 44 in the direction of directional arrow "b" toward platform 12 (FIG. 10) to assume the horizontal position depicted in FIG. 11. During pivotal movement, at least a portion of base segment 20 is received within channel or groove 56 defined in platform 12 (see also FIG. 5) to permit positioning of mirror support 14 in a horizontal orientation relative to platform 12. In the horizontal position, mirror apparatus 10 presents a flat profile for storage in a suitcase, drawer or the like. To return mirror support 14 to the first operative position, mirror support 14 is pivotal in the direction opposite to directional arrow "b" to assume the vertical or upright orientation of base segment 20 and c-shaped frame segment 22. Locking nut 38, may be advanced along threaded segment 42 of base segment 20 through rotational movement in the direction of directional arrow "m1" (FIG. 7) to secure the locking nut 38 against platform 12.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A mirror apparatus, which comprises:

a platform;

a mirror support depending from the platform, the mirror support mounted for movement relative to the platform between a first operative position and a second transport position;

a mirror member mounted to the mirror support, the mirror member including a first mirror side having a substantially planar mirror surface and a second mirror side having a magnifying mirror surface;

a locking member mounted to the mirror support, the locking member movable between an engaged position fixedly securing the mirror support in the first operative position and a disengaged position permitting the mirror support to move to the second transport position; and an illuminating member mounted about at least a peripheral segment of the mirror member for providing illumination.

2. The apparatus according to claim 1 wherein the mirror support is mounted for pivotal movement relative to the platform between the first operative position and the second transport position.

3. The apparatus according to claim 2 wherein the mirror support is adapted to be releasably secured in the first operative position.

4. The apparatus according to claim 2 wherein the mirror support includes a frame segment for supporting the mirror and a base segment connecting the mirror support to the platform.

5. The apparatus according to claim 4 wherein the base segment of the mirror support is connected to the platform via a hinge, the base segment adapted to pivot about the hinge between positions corresponding to the first operative and the second transport positions of the mirror support.

6. The apparatus according to claim 4 wherein the mirror member is mounted for pivotal movement relative to the frame segment of the mirror support to permit either the first or second mirror sides to face the user.

7. The apparatus according to claim 1 wherein the illuminating member is dimensioned and arranged to illuminate the first mirror side and the second mirror side.

8. A mirror apparatus, which comprises:

a platform;

a mirror support depending from the platform and being mounted for pivotal movement relative to the platform between a first operative position and a second transport position, the mirror support including a frame segment and a base segment connecting the mirror support to the platform;

a mirror member supported by the frame segment of the mirror support, the mirror member including a first mirror side having a substantially planar mirror surface and a second mirror side having a magnifying mirror surface;

a locking member mounted to the base segment of the mirror support, the locking member movable between an engaged position securing the mirror support in the first operative position and a disengaged position permitting the mirror support to move to the second transport position; and an illuminating member mounted about at least a peripheral segment of the mirror member for providing illumination.

9. The apparatus according to claim 8 wherein the locking member includes a locking nut mountable to the base segment of the mirror support, the locking nut threadably engageable with a corresponding locking thread on the base segment, and movable to be secured against the platform to releasably secure the mirror support in the first operative position of the mirror support, and further movable to be disengaged relative to the platform to permit the mirror support to move to the second transport position.

10. The apparatus according to claim 9 wherein the platform includes a recessed segment, the recessed segment dimensioned to at least partially accommodate the base segment of the mirror support when in the second transport position of the mirror support.

11. The apparatus according to claim 10 wherein the illuminating member is dimensioned to encircle the mirror member.

12. The apparatus according to claim 8 wherein the mirror member is mounted for pivotal movement relative to the mirror support to permit either the first or second mirror sides to face the user.

* * * * *